US009604480B2

(12) United States Patent
Albonetti et al.

(10) Patent No.: US 9,604,480 B2
(45) Date of Patent: Mar. 28, 2017

(54) APPARATUS FOR PRINTING CLOSURE BODIES OF CONTAINERS

(71) Applicant: SACMI IMOLA S.C., Imola (IT)

(72) Inventors: Danilo Albonetti, Imola (IT); Dario Beltrandi, Imola (IT); Gildo Bosi, Bagnacavallo (IT)

(73) Assignee: SACMI IMOLA S.C., Imola (IT)

( * ) Notice: Subject to any disclaimer, the term of this patent is extended or adjusted under 35 U.S.C. 154(b) by 0 days.

(21) Appl. No.: 14/906,491

(22) PCT Filed: Jul. 16, 2014

(86) PCT No.: PCT/EP2014/065228
§ 371 (c)(1),
(2) Date: Jan. 20, 2016

(87) PCT Pub. No.: WO2015/010984
PCT Pub. Date: Jan. 29, 2015

(65) Prior Publication Data

US 2016/0159119 A1 Jun. 9, 2016

(30) Foreign Application Priority Data

Jul. 25, 2013 (IT) ..... VR2013A0177

(51) Int. Cl.
*B41J 13/10* (2006.01)
*B41J 3/407* (2006.01)
(Continued)

(52) U.S. Cl.
CPC ..... *B41J 13/10* (2013.01); *B41J 2/2117* (2013.01); *B41J 2/475* (2013.01); *B41J 3/4073* (2013.01)

(58) Field of Classification Search
None
See application file for complete search history.

(56) References Cited

U.S. PATENT DOCUMENTS 4,373,437 A 2/1983 Rodenbaugh et al.
7,997,201 B2 * 8/2011 Till ..... B41J 3/4073 101/35

(Continued)

FOREIGN PATENT DOCUMENTS

CA 2366598 A1 9/2000
JP 2003011342 A 1/2003
WO 102006019441 A1 10/2007

OTHER PUBLICATIONS

International Search Report issued Sep. 9, 2014 re: Application No. PCT/EP2014/065228; pp. 1-3; citing: DE 10 2006 019441 A1, US 4 373 437 A and JP 2003 011342 A.

(Continued)

*Primary Examiner* — Lisa M Solomon
(74) *Attorney, Agent, or Firm* — Cantor Colburn LLP

(57) ABSTRACT

An apparatus for printing closure bodies of containers having a transfer device that is associated in input with a feeder of closure bodies to be printed and in output with an unloader of printed closure bodies. The transfer device defines seats for a respective closure body to be printed which are provided with at least one resting region for at least one abutment portion defined on the outer lateral surface of the respective closure body. The seats are mutually spaced at preset distances and movable along a transfer trajectory. The apparatus includes a device for digital printing of the closure bodies to be printed which is arranged along the transfer trajectory.

15 Claims, 7 Drawing Sheets

(51) Int. Cl.
*B41J 2/21* (2006.01)
*B41J 2/475* (2006.01)

(56) References Cited

U.S. PATENT DOCUMENTS

| | | | |
|---|---|---|---|
| 2009/0065151 | A1 | 3/2009 | Mochida et al. |
| 2011/0146880 | A1 | 6/2011 | Kramer et al. |
| 2011/0232514 | A1 | 9/2011 | Putzer et al. |

OTHER PUBLICATIONS

Written Opinion issued Sep. 9, 2014 re: Application No. PCT/EP2014/065228; pp. 1-5; citing: DE 10 2006 019441 A1, US 4 373 437 A and JP 2003 011342 A.

* cited by examiner

APPARATUS FOR PRINTING CLOSURE BODIES OF CONTAINERS

TECHNICAL FIELD

Background

Apparatuses for printing closure bodies of containers such as, for example, caps for vessels or for containers made of plastics or metal, are known and are widely used.

Traditionally the printing of closure bodies that are intended for closing containers is done by way of print rollers or print pads by way of rotogravure, pad and offset printing processes.

Specifically, the caps are taken from a cooling and storage magazine to be fed to a belt or a chain which supports pins, or holders, over which the caps to be printed are fitted.

Another printing method involves the use of a wheel on the peripheral region of which the above mentioned holders or pins are applied radially.

The chain or the wheel thus conveys the closure bodies toward a print station constituted, for example, by printing rollers or by pads which make contact with the upper surface of the cap.

The solution described above evidently suffers many drawbacks.

Firstly the cap, during the printing operations, is subjected to a fairly high pressure by the printing device (be it a printing roller or a pad) and, thus, it is not possible to perform the printing on the caps immediately after they are produced, and instead it is necessary to await, before sending them to the printing apparatus, the complete solidification which occurs, typically, some hours after they have been formed.

This results in the necessity of providing a cooling and storage warehouse and, consequently, means of feeding the caps that have just been formed to the cooling and storage warehouse, and means of taking the cooled caps from the cooling and storage warehouse in order to send them to the printing apparatus.

The above considerations apply both to closure bodies made of plastics and to caps made of metal which have an inner gasket seal.

Furthermore, it should be noted that fitting the caps to be printed over the pins supported by the belt or by the chain is a particularly critical aspect, in terms of implementation.

Finally, it should be noted that the apparatuses known today are not very flexible if the user wants to change the formats or the images to be printed, since this involves changing the printing rollers or the printing plates.

Such problem is nowadays extremely felt in that increasingly often the users require exceptional flexibility and frequent format changes.

It should be noted, furthermore, that traditional printing involves heating by way of flaming of the surface of the closure bodies to be printed, in order to make the inks adhere better.

However, heating through flaming brings a degradation of the chemical/physical characteristics of the closure bodies with consequent deterioration of the mechanical characteristics and thus of the quality of the products.

The aim of the present invention is to eliminate, or at least to drastically reduce, the above mentioned drawbacks.

SUMMARY

Within this aim, an object of the invention is to provide an apparatus for printing closure bodies of containers which makes it possible to vary the image to be printed extremely rapidly.

Another object of the invention is to make available an apparatus for printing closure bodies of containers which can also be used for printing closure bodies that have not yet solidified completely.

This aim and these and other objects which will become better apparent hereinafter are achieved by an apparatus for printing closure bodies of containers according to appended claim 1.

BRIEF DESCRIPTION OF THE DRAWINGS

Further characteristics and advantages of the invention will become better apparent from the description of some preferred but not exclusive embodiments of an apparatus for printing closure bodies of containers according to the invention, which are illustrated by way of non-limiting example in the accompanying drawings wherein:

FIG. 9 shows the pre-deformed image necessary in order to obtain on the closure body, which can move along a curvilinear transfer trajectory, the image to be printed shown in FIG. 8; while

DETAILED DESCRIPTION OF THE DRAWINGS

Figure 1:
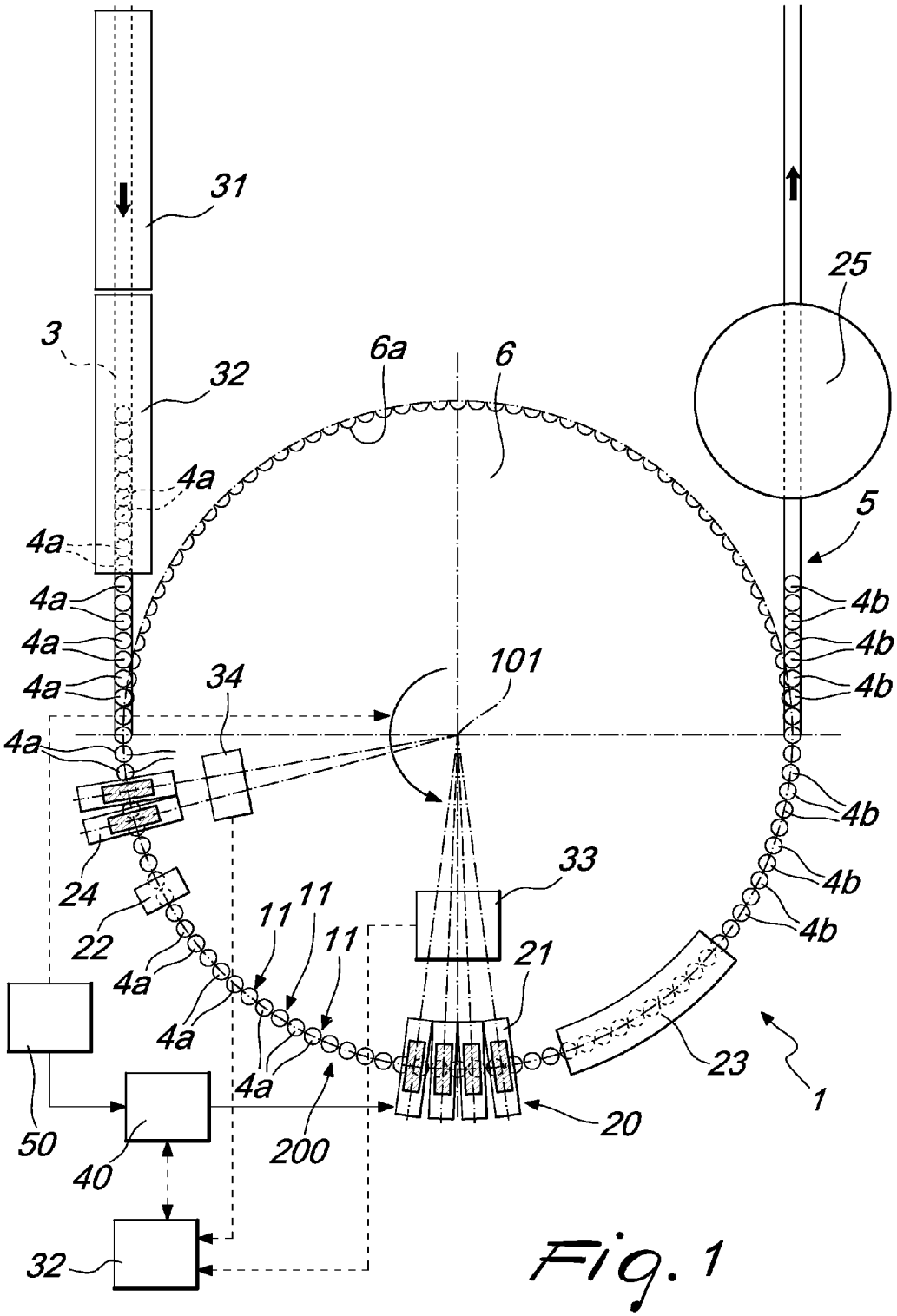
FIG. 1 is a schematic view from above of an apparatus for printing closure bodies of containers according to the invention.

The present invention relates to an apparatus, generally indicated with the reference numeral 1, for printing closure bodies of containers, such as for example, caps made of plastics or metal.

The apparatus 1 comprises a transfer device 2 associated in input with a feeder 3 of closure bodies to be printed 4*a* and in output with an unloader 5 of the printed caps 4*b*.

Figure 7:
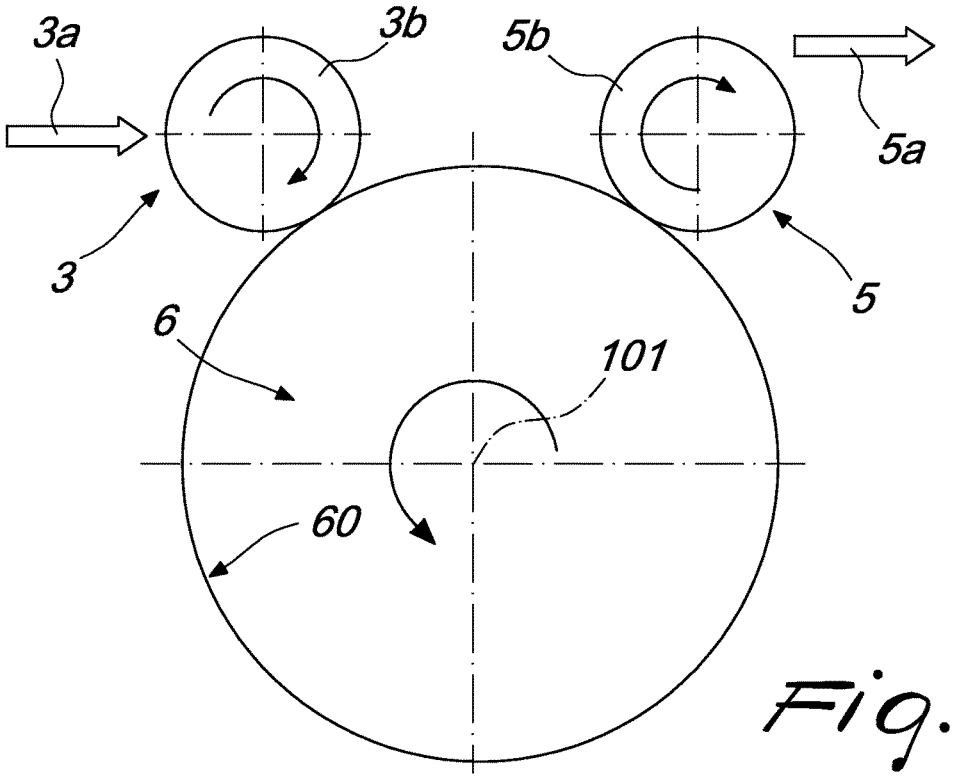
FIG. 7 is a schematic view from above of the apparatus provided with a different arrangement of the feeder and of the unloading of the closure bodies of containers.

With reference to the embodiment shown in FIG. 1, the feeder 3 can be arranged parallel to and opposite the unloader 5 with respect to the transfer device 2 but also, as shown in the diagram in FIG. 7, the feeder 3 can be constituted by a supply line 3*a* leading into a loading carousel 3*b* that is adapted to feed the closure bodies to be printed 4*a* to the transfer device 2 and, in turn, the unloader 5 can be constituted by an unloading carousel 5*b* that is adapted to take the printed closure bodies 4*b* from the transfer device 2 in order to send them to an unloading line 5*a*.

According to the present invention, the transfer device 2 defines a plurality of seats 11 for a respective closure body to be printed 4*a*.

The seats 11 have at least one resting region 12 for at least one abutment portion 13 defined on the outer lateral surface 14 of the respective closure body 4*a*, 4*b*.

The seats 11 are mutually spaced at preset distances and are movable along a transfer trajectory designated with the reference numeral 200.

Advantageously the transfer trajectory 200 has a circular extension.

The apparatus 1 comprises, furthermore, a device 20 for the digital printing of the closure bodies to be printed 4*a*, which is arranged along the transfer trajectory 200.

Conveniently, the digital printing device 20 is adapted to print at least one portion of the outer surface of the closure body 4 and, preferably, the upper outer surface of the closure body.

The digital printing device 20 is composed of a variable number of print heads as a function of the speed and colors required.

Each print head is arranged, conveniently, so as to present a row or multiple rows of nozzles arranged at right angles to the extension of the transfer trajectory 200 of the closure bodies.

If the transfer trajectory 200 has a circular extension, then each row of nozzles extends radially to such circular extension: in particular, for heads with only one row of nozzles, such row is arranged on a radius of the transfer trajectory 200 while, for two or more rows of nozzles, the central axis of the head which is parallel to the rows of nozzles is arranged on a radius of the transfer trajectory 200.

Advantageously, the seats 11 are associated with means 8 for preventing the rotation of the respective closure body to be printed 4*a* about its own longitudinal axis 100.

Preferably, the resting region 12 comprises the top region of the outer lateral surface 14 of the closure body 4*a*, 4*b*.

In fact it has been found that such region is the one with the most regular shape structure and is substantially more rigid than the remaining part of the outer lateral surface 14.

In fact, with reference to closure bodies such as caps made of plastics, extraction of the caps from the formation mold determines a non-uniform radial deformation of the lateral surface thereof.

The fact that the resting region 12 is constituted by the top region of the outer lateral surface 14 makes it possible to execute a perfectly centered positioning of the closure body to be printed 4*a* along the transfer trajectory 200 so as to ensure the centering of the printing on the upper surface with respect to the theoretical geometric center.

According to a preferred embodiment, the transfer device 2 comprises a disk 6 that can rotate about a movement axis 101.

Conveniently, the disk 6 is supported so that it can rotate, about the movement axis 101, by a baseplate 60.

The disk 6 has, at its peripheral region 6*a*, the plurality of seats 11, which are mutually angularly spaced in a regular manner about the movement axis 101.

Advantageously, the apparatus 1 comprises a device 40 for actuating the digital printing device 20: in particular, the actuation device 40, optionally associated with a control panel 32, is connected functionally to a device 50 for controlling the movement of the seats 11 along the transfer trajectory 200.

Specifically, the actuation device 40 is connected functionally to the device for the movement of the disk 6 about the movement axis 101.

With particular reference to the embodiment shown in the figures, the seats 11 comprise a recess 11*a* that is extended along a circumferential portion that has a radius of curvature that corresponds substantially to the radius of the top region of the lateral surface 14 of the closure body 4*a*, 4*b*.

Below each recess 11*a*, there can be a cut out that is distanced from a portion facing toward it of the outer lateral surface 14 of the closure body.

The transfer device 2 comprises, furthermore, a resting body 7, advantageously flat, which is arranged below the disk 6 and facing it.

The resting body 7 rotates integrally with the disk 6 about the movement axis 101.

In particular, the closure bodies to be printed 4*a* which are accommodated in the seats 11 are intended to rest with their lower free edge 16 on the resting body 7.

According to a first embodiment, the means 8 of preventing the rotation of the closure body to be printed 4*a* about its own longitudinal axis 100 comprise an air intake duct, designated with the reference numeral 8*a*.

The intake duct 8*a* ends at at least one first intake 8*b* which is arranged so as to face the outer lateral surface 14 of the cap to be printed 4.

Advantageously, the first intake 8*a* leads to the cut out underlying the recess 11*a*: the space interposed between the aforementioned cut out and the outer lateral surface 14 of the closure body facing it defines a sort of "reservoir" within which to create a depression so as to retain the closure body 4*a* engaged and centered in the respective seat 11.

In addition or as an alternative, the means 8 of preventing the rotation of the closure body to be printed 4*a* about its own longitudinal axis 100 comprise an air intake duct, designated with the reference numeral 8*c*.

The intake duct 8*c* ends at at least one intake opening 8*d* that is arranged in the region delimited by the lower free edge 16 of the closure body.

Figure 2:
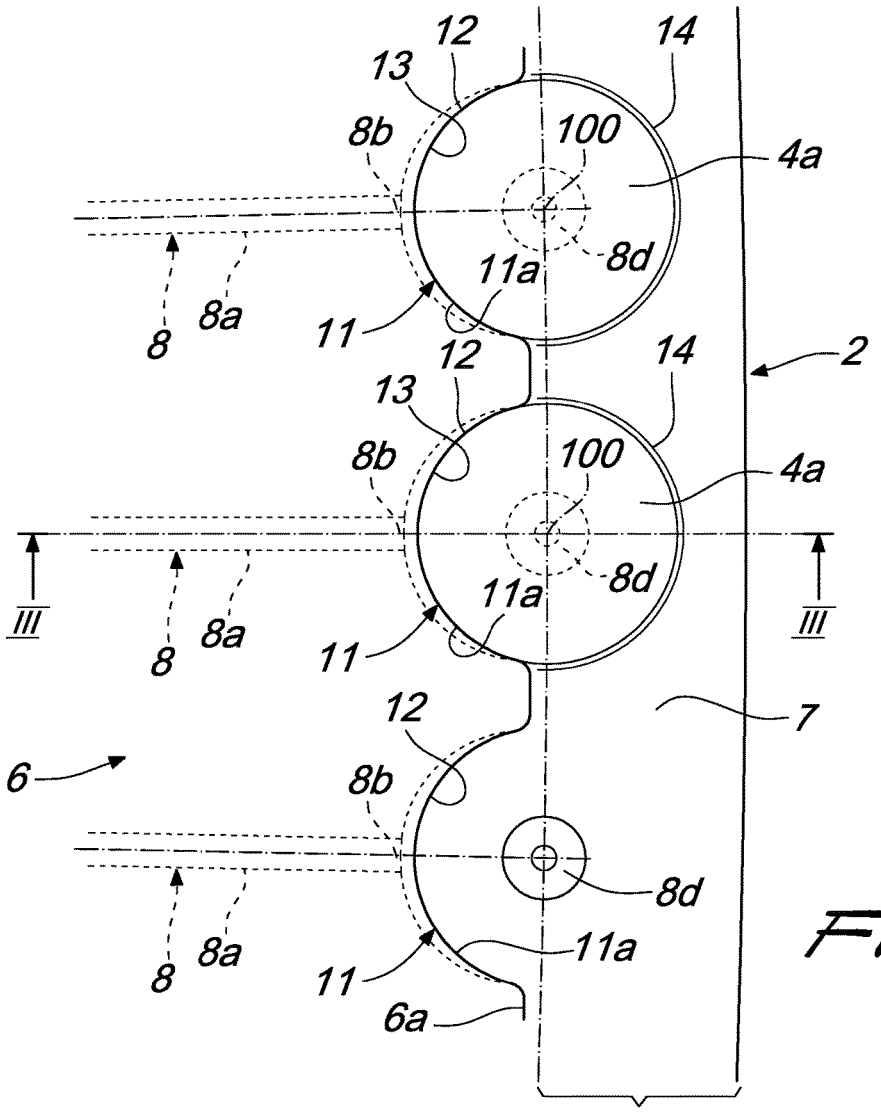
FIG. 2 is an enlarged-scale view from above of a portion of the apparatus according to the invention.
Figure 3:
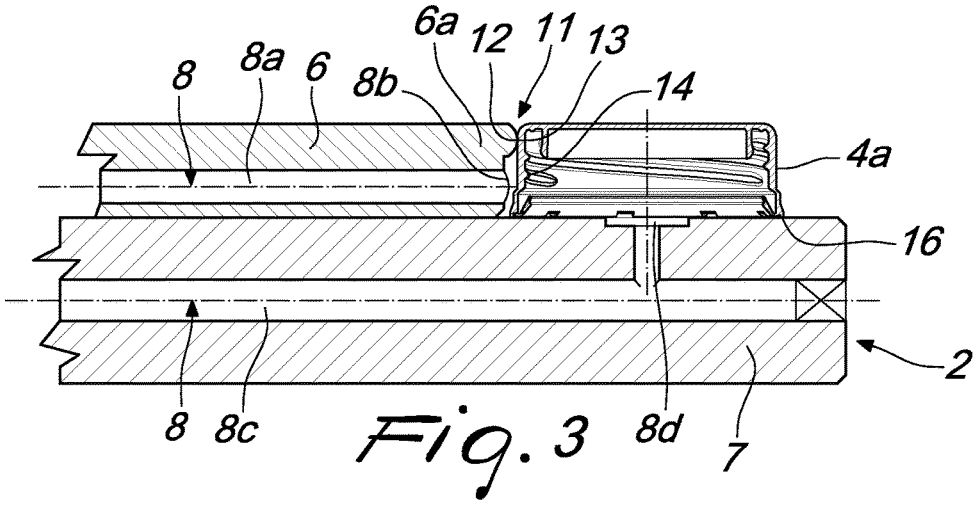
FIG. 3 is a sectional view of the portion of the apparatus, taken along the line in FIG. 2.

With reference to the embodiment shown in FIGS. 2 and 3, it is possible for the intake opening 8*d* to be arranged substantially at the longitudinal axis 100 of the closure body to be printed 4*a*.

Figure 4:
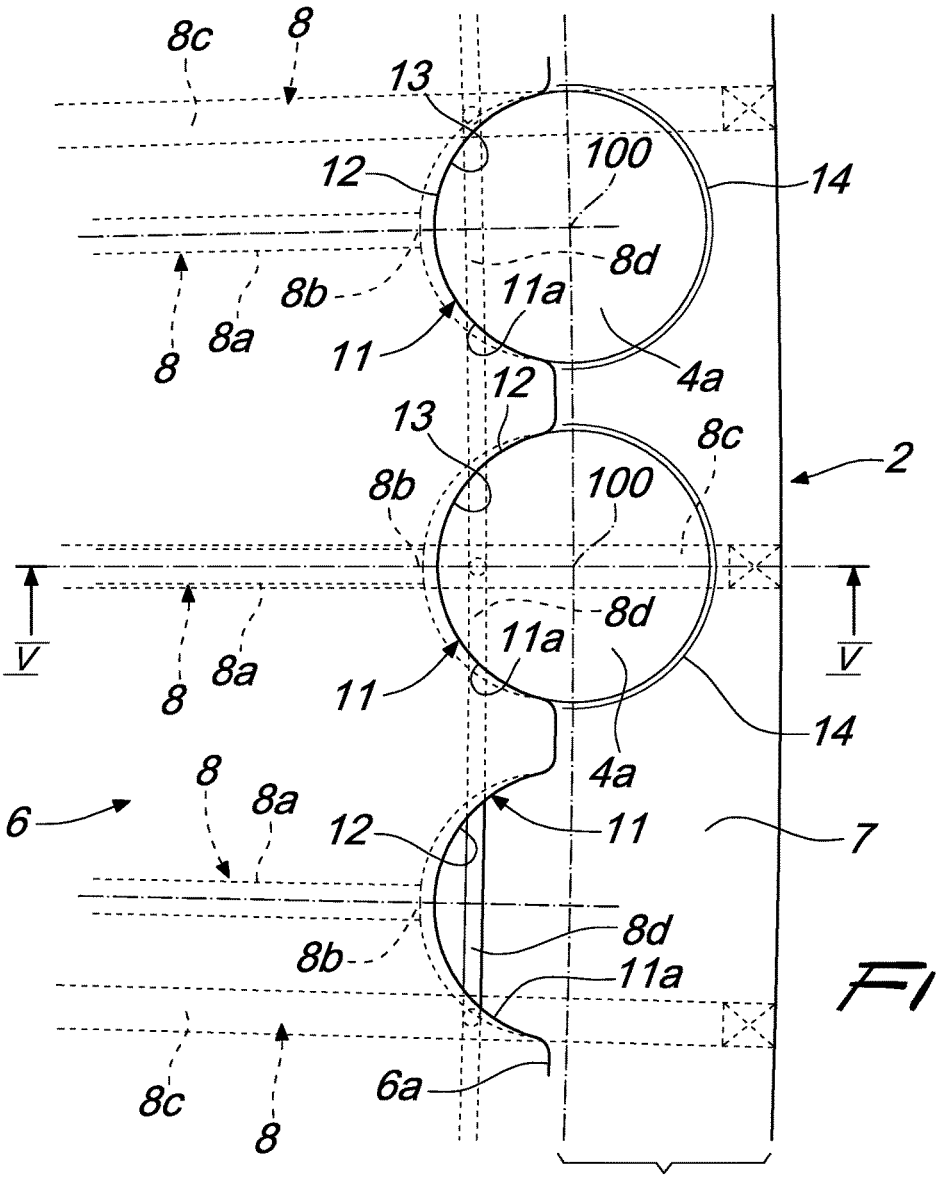
FIG. 4 is an enlarged-scale view from above of a portion of a variation of embodiment of the apparatus according to the invention.
Figure 5:
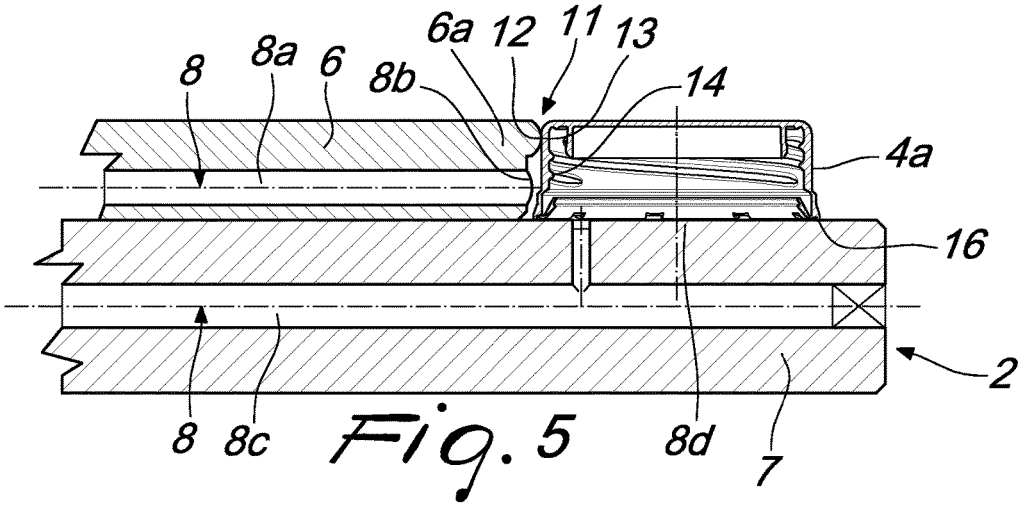
FIG. 5 is a sectional view of the portion of the apparatus, taken along the line V-V in FIG. 4.
Figure 6:
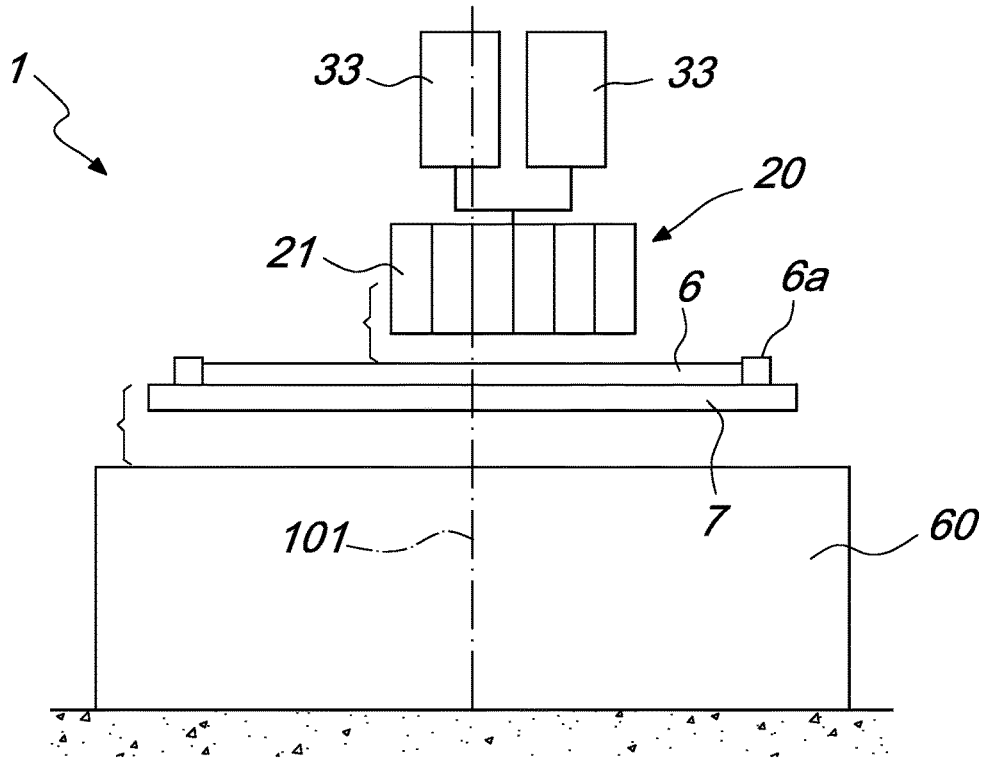
FIG. 6 is a schematic side view of an apparatus for printing closure bodies of containers.

With reference to the variation of embodiment illustrated in FIGS. 4 and 5, it has been found to be advantageous to have the intake duct 8*c* connected to the intake opening 8*d* which extends circumferentially about the movement axis 101 so as to enable the retaining of the closure bodies to be printed 4*a* independently of the size of the seats 11.

Preferably, the transfer device 2 comprises at least two disks 6, which are selectively associable with the resting body 7, having seats 11 of different dimensions in order to be capable of printing closure bodies 4*a* of different shape or size.

This makes it possible to use the transfer device 2, and in particular the same resting body 7, for printing closure bodies 4*a* that have different outer diameters.

As mentioned previously, in this case it will be extremely advantageous to have the intake duct 8*c* end in the circumferentially-extending intake opening 8*d* in that, in this manner, the same resting body 7 can be used for the different disks 6.

The means 8 of preventing the rotation of the closure body to be printed 4*a* about its own longitudinal axis 100 can also be constituted by centering and retaining pins that extend along the longitudinal axis 100 of the closure bodies and are supported by the transfer device 2.

The digital printing device 20 comprises at least one inkjet printing device 21, for example with four colors (cyan, magenta, yellow and black) which constitute the basic colors with which to obtain any color combination.

The inkjet printing device 21 can be associated with a first reservoir of colors 33.

If it is required to cover the surface to be printed of the closure body, for example using the color white, it is possible for the printing device 20 to comprise an additional printing station 24, optionally associated with a second tank 34, arranged upstream of the inkjet printing device 21 along the transfer trajectory 200.

The additional printing station 24 can have one or more print heads supplied, for example, with white ink.

Downstream of the inkjet printing device 21 and optionally of the additional printing station 24 there can be, respectively, a first and a second device 23 and 22 for irradiating the deposited ink.

The first and/or second device for irradiating 22 and 23 can be constituted by lamps of the UV LED type that produce an immediate reticulation of the inks; such lamps, furthermore, have extremely limited encumbrances and do not produce an excessive amount of heat.

Specifically, the second device for irradiating 22 is intended to produce the reticulation of the optional white ink deposited by the additional printing station 24, while the first device for irradiating 23 produces the reticulation of the colors deposited by the inkjet printing device 21.

In order to increase printing speed, it is possible to provide for the installation of two or more print heads for each individual color.

According to a particularly important aspect of the present invention, the digital printing device 20 is associated with a compensation device that is adapted to deform the image to be printed.

Figure 8:
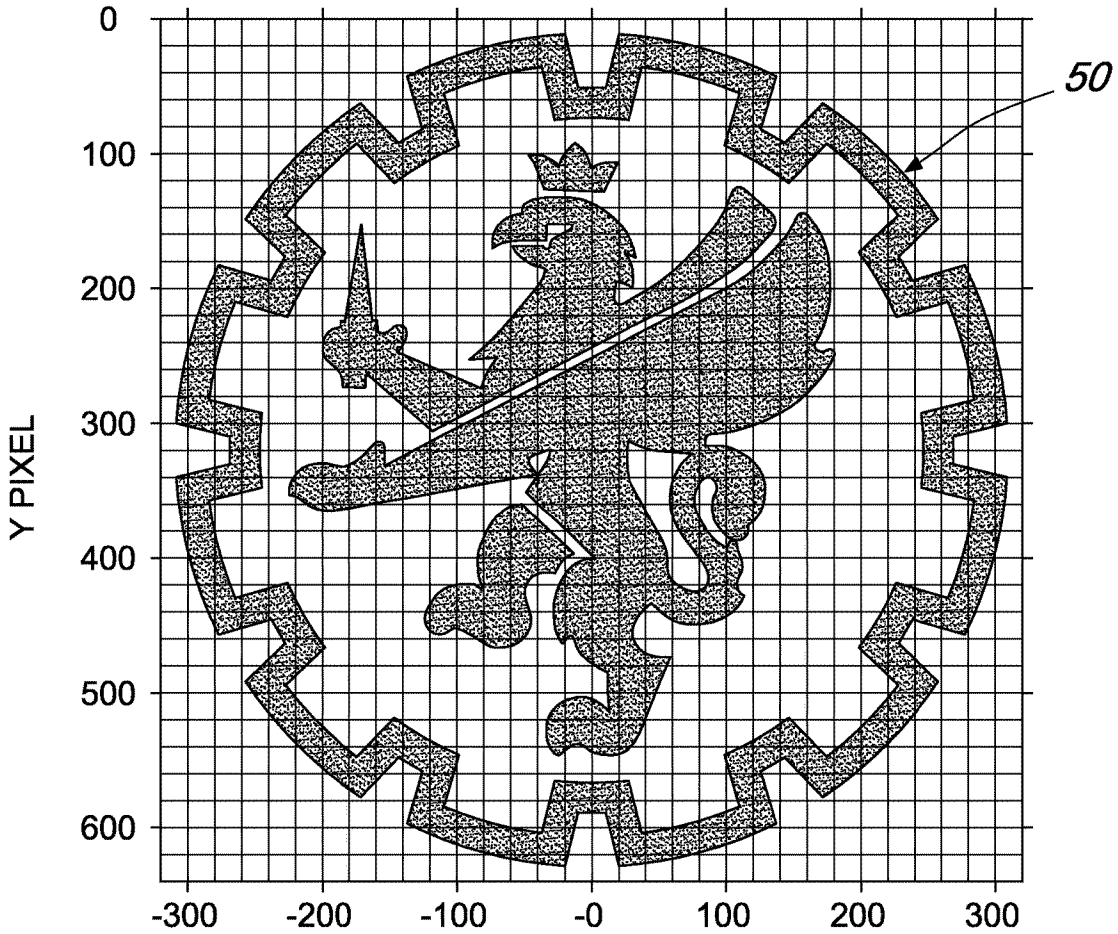
FIG. 8 shows an example of a image to be printed on the closure body.
Figure 9:
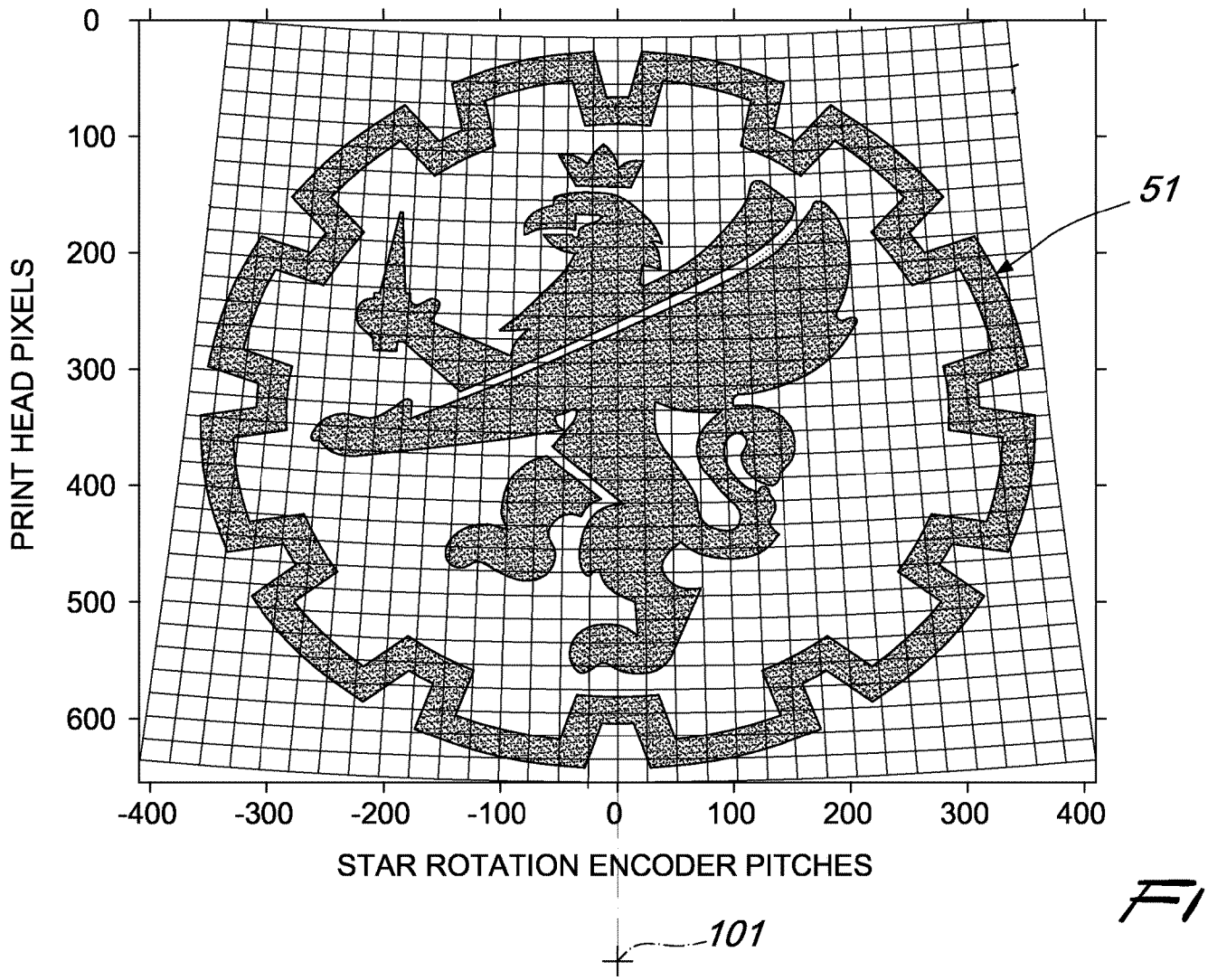

In fact, in order to be able to correctly print the image on the closure body 4*a* (take for example the image 50 shown in FIG. 8) when the latter is moved along a transfer trajectory 200 that is not straight with respect to each print head, it is necessary to deform the original image (as shown in FIG. 9) that is to be printed, with a rule that is the inverse of the deformation that the image will undergo during the printing process.

Such deformed image, designated with the reference numeral 51 in FIG. 9, is obtained by using, advantageously, an algorithm that takes, as entry parameters, one or more of the items of data listed below:

- the original image that is to be printed;
- the size of the original image (from which the effective DPI, dots per inch, is derived);
- the distance between the longitudinal axis 100 of the closure body to be printed 4*a* and the movement axis 101 of the disk 6 (the movement axis 101 is below FIG. 9;
- the number of turn points of the encoder of the disk 6 (print clock);
- the resolution in DPI of the print head or print heads;
- the distance between the rows of nozzles.

The images have different deformations according to the number of rows of nozzles that are positioned radially with respect to the extension of the transfer trajectory 200.

If the digital printing device 20 has two rows of nozzles, the synchronism difference compensates for the print delay during the rotation of the two rows of nozzles, while the deformation of the grid compensates for the print rotary motion.

Figure 10:
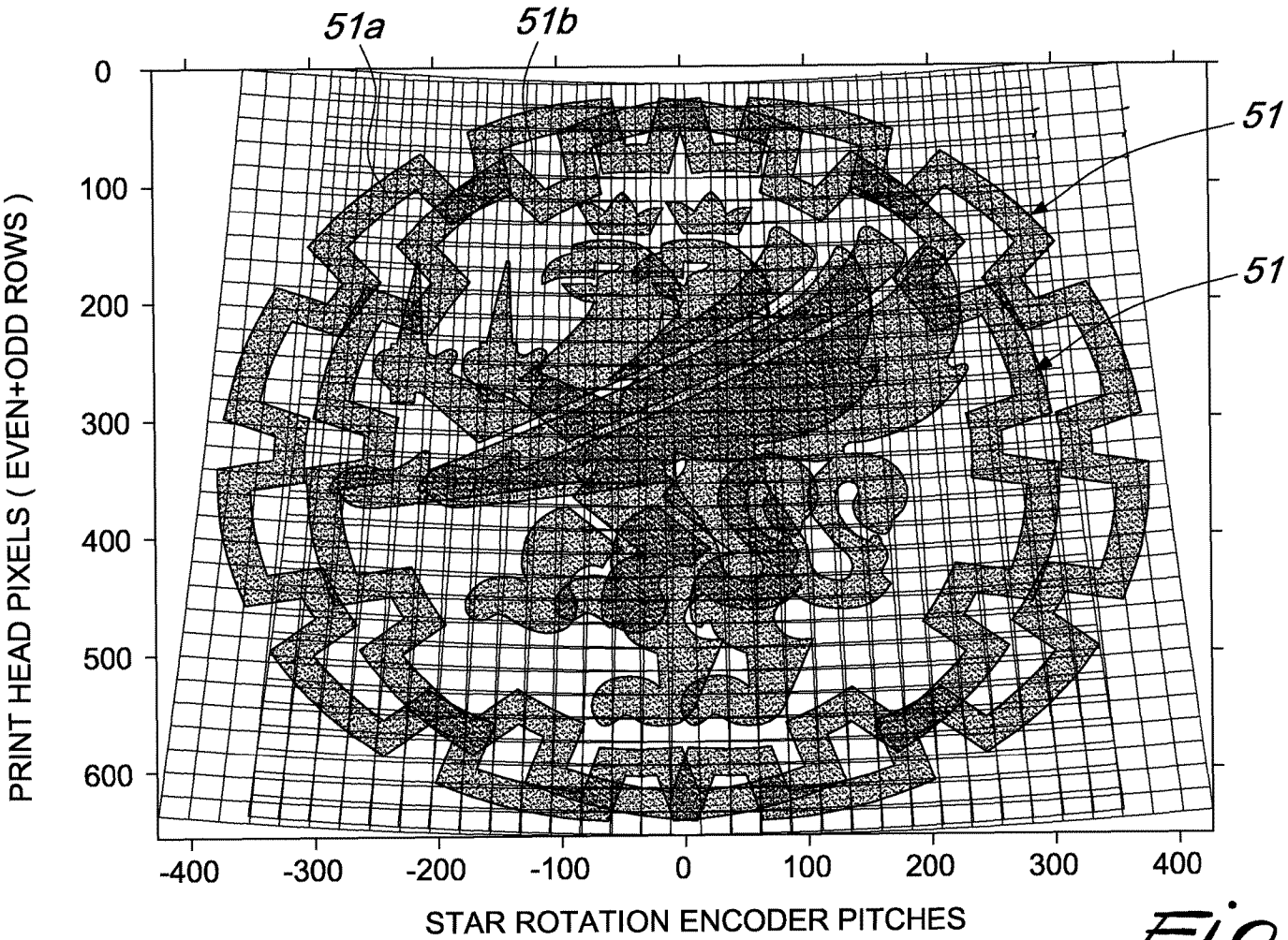
FIG. 10 shows two deformed images which will be printed by a first and by a second print head which are mutually spaced apart along the extension of the transfer trajectory.

By way of example, FIG. 10 shows two deformed images 51*a* and 51*b* to be printed, respectively, by a first and by a second row of print nozzles.

It has been found through experimentation that it is possible to print correctly only by using heads with one row or two rows of nozzles.

In order to increase the native resolution of the print heads it is possible to use multiple heads with one or two rows of nozzles, each one of which must be positioned radially, and the nozzles must trace the marks on the piece in rotation in an intertwined manner (their distance from the center of rotation must differ by an amount equal to the interlacing pitch).

Operation of an apparatus 1 for printing closure bodies is evident from the foregoing description.

In particular, the closure bodies 4*a* to be printed, which can be taken, without distinction, from a cooling and storage warehouse but also directly, still "warm" or with parts still warm, from the formation device, are moved along the feeder 3.

Along the feeder 3 there can be a station for the surface treatment 31, 32 of the closure bodies to be printed 4*a*.

Such surface treatment stations 31, 32 can be of the "corona" or "plasma" type and their function is to eliminate all trace of grease on the surface layer of the closure bodies so as to facilitate the adhesion of the inks.

The feeder 3 transfers the closure bodies to be printed 4*a* to a respective seat 11 which is defined on the transfer device 2 which is constituted, for example, by the resting body 7 and by the disk 6 superimposed upon it.

Thanks to the action of the means 8 for preventing rotation and to the particular shape of the seats 11, the closure bodies to be printed 4*a* are moved with extreme precision along the transfer trajectory 200 thus enabling the digital printing device 20 (constituted by the inkjet printing device 21 and, optionally, by the digital printing station 24) to print free from imperfections or inaccuracies owing to imperfect relative positioning between the closure body to be printed 4*a* and the digital printing device 20.

In this regard, along the unloader 5 there can be a device 25 for checking the printed image.

Other systems of moving the closure bodies, such as for example conveyor belts, would not over time ensure the necessary accuracy of movement, in addition to requiring continuous adjustment and maintenance.

In practice it has been found that in all the embodiments the invention has achieved the intended aim and objects.

In particular, preventing the caps to be printed 4*a* from rotating at a portion of their outer lateral surface 14, and specifically the top region, enables an extremely rapid transfer of the caps to be printed 4*a* from the feeder 3 to the transfer device 2 and, at the same time, an extremely precise positioning that enables the printing device 20, which is synchronized in its operation with the movement of the transfer device 2, to print with great accuracy.

The use of a digital printing device 20 that has the primary characteristic of "non-contact printing" of the object to be decorated, and of seats 11 that abut against a portion of the outer lateral surface of the cap 4, furthermore even makes it possible to print on caps that are still warm and consequently have not yet completely solidified, thus making it possible to have the apparatus 1 in line with the devices for forming the caps, without needing to interpose a cooling and storage warehouse.

All the characteristics of the invention, indicated above as advantageous, convenient or similar, may also be missing or be substituted by equivalent characteristics.

Thus, for example, the present invention relates to an apparatus 1 for printing closure bodies of containers which comprises a transfer device 2 that is associated in input with a feeder 3 of closure bodies to be printed 4*a* and in output with an unloader 5 of printed closure bodies 4*b*.

The transfer device 2 defines a plurality of seats 11 for a respective closure body to be printed 4*a*.

The seats 11 can comprise respective pins for centering and retaining, which are arranged parallel to the longitudinal axis 100 of the closure bodies and are supported by the transfer device 2.

The centering pins engage with a portion defined on the inner lateral surface of the respective closure body.

The seats 11, and specifically the centering pins, are mutually spaced apart at preset distances and are movable along a transfer trajectory 200.

The apparatus 1 comprises a device 20 for the digital printing of the closure bodies to be printed 4*a*, which is arranged along the transfer trajectory 200.

Such centering pins can likewise also define the means 8 of preventing the rotation of the closure body to be printed 4*a* about its own longitudinal axis 100.

The transfer device 2 comprises a disk 6 that can rotate about a movement axis 101 and has, at its peripheral region 6*a*, the plurality of seats 11 which are defined by the centering pins and are mutually angularly spaced in a regular manner about the movement axis 101.

The centering pins extend parallel to the movement axis 101 of the disk 6.

The individual characteristics set out in reference to general teachings or to specific embodiments may all be present in other embodiments or may substitute characteristics in such embodiments.

The invention, thus conceived, is susceptible of numerous modifications and variations, all of which are within the scope of the appended claims.

In practice the materials employed, provided they are compatible with the specific use, and the dimensions and shapes, may be any according to requirements.

Moreover, all the details may be substituted by other, technically equivalent elements.

The disclosures in Italian Patent Application No. VR2013A000177 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. An apparatus for printing closure bodies of containers, which comprises a transfer device that is associated in input with a feeder of closure bodies to be printed and associated in output with an unloader of printed closure bodies, wherein said transfer device defines a plurality of seats for a respective closure body to be printed which are provided with at least one resting region for at least one abutment portion that is defined on an outer lateral surface of the respective closure body, each of said plurality of seats being spaced at preset distances about a movement axis and being movable along a transfer trajectory, said apparatus comprising a digital printing device configured for digital printing of said closure bodies to be printed which is arranged along said transfer trajectory, wherein said transfer device includes a disk that can rotate about a movement axis and has, at a peripheral region thereof, said plurality of seats, which are mutually angularly spaced in a regular manner around said movement axis, and said transfer device further includes a resting body that is arranged so as to face said disk from below, said closure bodies to be printed accommodated in said seats being intended to rest with a lower free edge on said resting body.

2. The apparatus according to claim 1, wherein the seats are associated with means for preventing the rotation of said closure body to be printed about the longitudinal axis of the closure body.

3. The apparatus according to claim 1, wherein the resting region includes a top region of the outer lateral surface of said closure body.

4. The apparatus according to claim 1, further comprising an actuation device configured for actuating said digital printing device which is connected to a control device configured for controlling a movement of said seats along said transfer trajectory.

5. The apparatus according to claim 3, wherein said seats comprise a respective recess that is extended along a circumferential portion that has a radius of curvature that corresponds substantially to a radius of the top region of the lateral surface of said closure body to be printed.

6. The apparatus according to claim 1, wherein said resting body rotates integrally with said disk about said movement axis.

7. An apparatus for printing closure bodies of containers, which comprises a transfer device that is associated in input with a feeder of closure bodies to be printed and associated in output with an unloader of printed closure bodies, wherein said transfer device defines a plurality of seats for a respective closure body to be printed which are provided with at least one resting region for at least one abutment portion that is defined on an outer lateral surface of the respective closure body, each of said plurality of seats being spaced at preset distances about a movement axis and being movable along a transfer trajectory, said apparatus comprising a digital printing device configured for digital printing of said closure bodies to be printed which is arranged along said transfer trajectory, wherein the seats are associated with means for preventing the rotation of said closure body to be printed about the longitudinal axis of the closure body and said means comprise an air intake duct that ends at at least one first intake that is arranged so as to face the outer lateral surface of said closure body to be printed.

8. An apparatus for printing closure bodies of containers, which comprises a transfer device that is associated in input with a feeder of closure bodies to be printed and associated in output with an unloader of printed closure bodies, wherein said transfer device defines a plurality of seats for a respective closure body to be printed which are provided with at least one resting region for at least one abutment portion that is defined on an outer lateral surface of the respective closure body, each of said plurality of seats being spaced at preset distances about a movement axis and being movable along a transfer trajectory, said apparatus comprising a digital printing device configured for digital printing of said closure bodies to be printed which is arranged along said transfer trajectory, wherein the seats are associated with means for preventing the rotation of said closure body to be printed about the longitudinal axis of the closure body and said means comprise an air intake duct that ends at at least one intake opening that is arranged in a region delimited by a lower free edge of said closure body.

9. An apparatus for printing closure bodies of containers, which comprises a transfer device that is associated in input with a feeder of closure bodies to be printed and associated in output with an unloader of printed closure bodies, wherein said transfer device defines a plurality of seats for a respective closure body to be printed which are provided with at least one resting region for at least one abutment portion that is defined on an outer lateral surface of the respective closure body, each of said plurality of seats being spaced at preset distances about a movement axis and being movable along a transfer trajectory, said apparatus comprising a digital printing device configured for digital printing of said closure bodies to be printed which is arranged along said transfer trajectory, wherein said transfer device includes a disk that can rotate about a movement axis and has, at a peripheral region thereof, said plurality of seats, which are mutually angularly spaced in a regular manner around said movement axis, said apparatus further comprising at least two disks having seats of different dimensions that can be associated selectively and detachably with said resting body.

10. The apparatus according to claim 1, wherein said digital printing device comprises at least one inkjet printing device.

11. An apparatus for printing closure bodies of containers, which comprises a transfer device that is associated in input with a feeder of closure bodies to be printed and associated in output with an unloader of printed closure bodies, wherein said transfer device defines a plurality of seats for a respective closure body to be printed which are provided with at least one resting region for at least one abutment portion that is defined on an outer lateral surface of the respective closure body, each of said plurality of seats being spaced at preset distances about a movement axis and being movable along a transfer trajectory, said apparatus comprising a digital printing device configured for digital printing of said closure bodies to be printed which is arranged along said transfer trajectory and includes an additional printing station arranged upstream of said inkjet printing device along the transfer trajectory and is supplied with white ink.

12. The apparatus according to claim 1, wherein said digital printing device comprises, downstream of said inkjet printing device, a first device for irradiating the printed surface, said first device comprising lamps of the UV LED type.

13. The apparatus according to claim 12, wherein said digital printing device comprises, downstream of said additional printing station, a second device for irradiating the printed surface, said second device comprising lamps of the UV LED type.

14. The apparatus according to claim 1, wherein said digital printing device comprises at least two print heads for each individual color.

15. The apparatus according to claim 1, wherein said digital printing device is associated with a compensation device that is adapted to deform the image to be printed with a rule that is the inverse of a deformation that the image will undergo during the printing process.

* * * * *